US009676211B2

(12) United States Patent
Takabatake et al.

(10) Patent No.: US 9,676,211 B2
(45) Date of Patent: Jun. 13, 2017

(54) PRINTER WITH A FIXED BLADE AND A MOVABLE BLADE THAT CUT RECORDING PAPER

(71) Applicant: FUJITSU COMPONENT LIMITED, Tokyo (JP)

(72) Inventors: Yoshinari Takabatake, Tokyo (JP); Sumio Watanabe, Tokyo (JP); Yukihiro Mori, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/450,326

(22) Filed: Aug. 4, 2014

(65) Prior Publication Data

US 2015/0061206 A1 Mar. 5, 2015

(30) Foreign Application Priority Data

Aug. 28, 2013 (JP) ..... 2013-177131

(51) Int. Cl.

| | |
|---|---|
| ***B41J 11/70*** | (2006.01) |
| ***B26D 1/08*** | (2006.01) |
| *B26D 5/08* | (2006.01) |
| *B26D 7/26* | (2006.01) |
| *B26D 7/00* | (2006.01) |

(52) U.S. Cl.

CPC ..... *B41J 11/70* (2013.01); *B26D 1/085* (2013.01); *B41J 11/703* (2013.01); *B41J 11/706* (2013.01); *B26D 5/083* (2013.01); *B26D 7/26* (2013.01); *B26D 2007/005* (2013.01)

(58) Field of Classification Search

CPC ..... B41J 11/703; B41J 11/706; B26D 1/08; B26D 1/085; B26D 5/083

See application file for complete search history.

(56) References Cited

U.S. PATENT DOCUMENTS

| | | | | |
|---|---|---|---|---|
| 5,749,277 | A | 5/1998 | Walker | |
| 5,974,930 | A | 11/1999 | Longrod | |
| 6,744,457 | B2 | 6/2004 | Seino et al. | |
| 7,547,154 | B2 * | 6/2009 | Kawaguchi | B26D 1/085 400/621 |
| 7,876,346 | B2 * | 1/2011 | Watanabe | B26F 1/18 347/222 |
| 2010/0086341 | A1 * | 4/2010 | Yokoyama et al. | 400/621 |
| 2010/0188470 | A1 | 7/2010 | Tsuchiya et al. | |
| 2011/0236117 | A1 * | 9/2011 | Tsuchiya | B26D 1/085 400/621 |
| 2013/0039686 | A1 | 2/2013 | Yazawa et al. | |

FOREIGN PATENT DOCUMENTS

| | | |
|---|---|---|
| JP | H07-068866 | 3/1995 |
| JP | H11-123692 | 5/1999 |
| JP | 2003-246104 | 9/2003 |
| WO | 2008/152339 | 12/2008 |

* cited by examiner

*Primary Examiner* — Blake A Tankersley
(74) *Attorney, Agent, or Firm* — IPUSA, PLLC

(57) ABSTRACT

A printer includes a fixed blade and a movable blade that cut recording paper subjected to printing by a print head, and a movable blade slider including a projecting part provided on a surface of the movable blade slider. The movable blade is provided on the movable blade slider with the projecting part of the movable blade slider entering an opening provided in the movable blade.

12 Claims, 7 Drawing Sheets

PRINTER WITH A FIXED BLADE AND A MOVABLE BLADE THAT CUT RECORDING PAPER

CROSS-REFERENCE TO RELATED APPLICATION

The present application is based upon and claims the benefit of priority of Japanese Patent Application No. 2013-177131, filed on Aug. 28, 2013, the entire contents of which are incorporated herein by reference.

BACKGROUND OF THE INVENTION

1. Field of the Invention

The present invention relates to printers.

2. Description of the Related Art

Printers that output receipts are widely used for shop registers and automated teller machines (ATMs) or cash dispensers (CDs) in banks. In such printers that output receipts, printing is performed on thermal paper serving as recording paper by a thermal head while conveying the recording paper, and after conveying the recording paper a predetermined length, the recording paper is cut by a cutter to the predetermined length.

Such printers include, for example, a printer body part and a lid part rotatably supported on the printer body part. It is possible to provide a roll of recording paper in the printer body part by opening the lid part. In this case, for example, a thermal head is provided in the printer body part and a platen roller is provided in the lid part, so that the recording paper is held between the thermal head and the platen roller by closing the lid part. Printing is performed on the recording paper by the thermal head with the recording paper thus being held between the thermal head and the platen roller.

A cutter provided in such printers cuts recording paper with a movable blade and a fixed blade. It is possible to cut the recording paper by causing the movable blade to move toward the fixed blade with the recording paper being between the movable blade and the fixed blade.

Reference may be made to Japanese Laid-Open Patent Applications No. 7-68866 and No. 2003-246104 for related art.

SUMMARY OF THE INVENTION

According to an aspect of the present invention, a printer includes a fixed blade and a movable blade that cut recording paper subjected to printing by a print head, and a movable blade slider including a projecting part provided on a surface of the movable blade slider. The movable blade is provided on the movable blade slider with the projecting part of the movable blade slider entering an opening provided in the movable blade.

DESCRIPTION OF THE EMBODIMENTS

Figure 1:
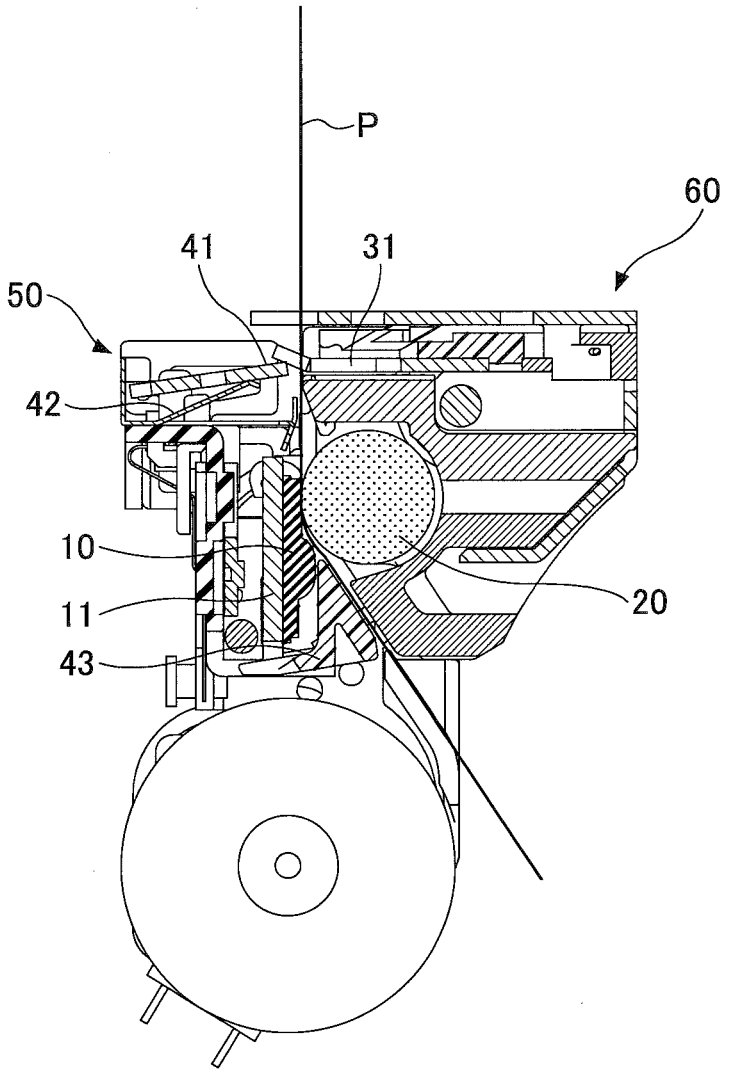
FIG. 1 is a cross-sectional view of a printer according to an embodiment.

An embodiment of the present invention is described below with reference to the accompanying drawings. In the following description, the same elements are referred to by the same reference numeral, and their description is not repeated.

[Printer]

A printer of this embodiment is described. Referring to FIG. 1, the printer of this embodiment includes a thermal head 10, a platen roller 20, a movable blade 31, and a fixed blade 41. The thermal head 10 serves as a print head that performs printing on recording paper P. The platen roller 20 conveys the recording paper P. The movable blade 31 and the fixed blade 41 cut the recording paper P. In this embodiment, printing is performed on the recording paper P such as thermal paper by the thermal head 10 with the recording paper P being held between the thermal head 10 and the platen roller 20.

The printer of this embodiment includes a printer body 50 and a lid 60. The lid 60 is attached to the printer body 50 so as to be openable and closable relative to the printer body 50. It is possible to load the printer body 50 with the recording paper P by opening the lid 60, and the thermal head 10 is made ready to perform printing on the recording paper P by closing the lid 60. FIG. 1 illustrates a state where the lid 60 is closed.

In this embodiment, the thermal head 10 and the fixed blade 41 are provided in the printer body 50, and the platen roller 20 and the movable blade 31 are provided in the lid 60.

Referring to FIG. 1, the movable blade 31 moves on the fixed blade 41 so as to cut the recording paper P. The fixed blade 41 is provided on a fixed blade spring 42. With the fixed blade 41 being provided on the fixed blade spring 42, resilience to urge the fixed blade 41 in an upward direction is exerted on the fixed blade spring 42. Therefore, when the movable blade 31 moves on the fixed blade 41 to cut the recording paper P, the fixed blade 41 is pressed against the movable blade 31 by the fixed blade spring 42. That is, with the movable blade 31 moving in contact with the fixed blade 41 to cut the recording paper P, the fixed blade 41 is pressing the movable blade 31 upward with below-described springs 42*a* (FIG. 9) pressing the fixed blade 41.

A recording paper guide 43 that forms a path for conveying the recording paper P is provided on part of a front surface of the thermal head 10 that serves as a printing surface, and a heat radiation plate 11 is provided on a rear surface of the thermal head 10.

[Movable Blade 31]

Figure 2:
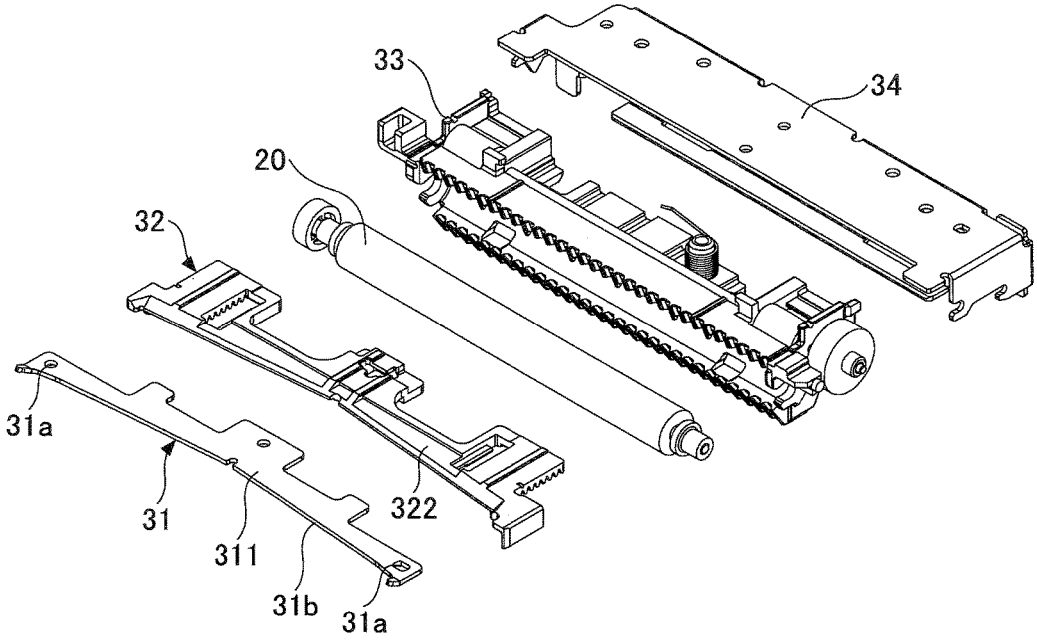
FIG. 2 is an exploded view of a movable blade unit of the printer according to the embodiment.

FIG. 2 is an exploded view of a movable blade unit of the printer of this embodiment. As illustrated in FIG. 2, the movable blade 31 forms part of the movable blade unit. The movable blade unit includes the movable blade 31, a movable blade slider 32, a movable blade frame 33, and a housing 34.

The movable blade 31 is formed of a material such as metal. The movable blade 31 includes a blade edge 31*b* formed along the length of the movable blade 31 in a flattened V-letter shape. An opening 31*a* is formed in the movable blade 31 near each of its lengthwise ends.

Figure 3:
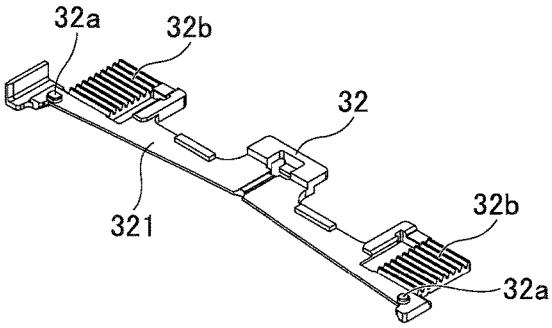
FIG. 3 is a perspective view of a movable blade slider.

The movable blade slider 32 is formed of a resin material. As illustrated in FIG. 3, a projecting part 32*a* is formed near each of the lengthwise ends of the movable blade slider 32 on a first surface 321 of the movable blade slider 32. The movable blade 31 is provided on the movable blade slider 32 by inserting the projecting parts 32*a* provided on the surface of the movable blade slider 32 into the corresponding openings 31*a* provided in the movable blade 31 with a first surface 311 of the movable blade 31 facing toward the first surface 321 of the movable blade slider 32. Accordingly, it is possible to easily provide the movable blade 31 on the movable blade slider 32, and it is possible to easily remove the movable blade 31 from the movable blade slider 32. In FIG. 2, the first surface 311 of the movable blade 31 and a second surface 322 of the movable blade slider 32 opposite to its first surface 321 are illustrated. In FIG. 3, the first surface 321 of the movable blade slider 32 is illustrated.

Figure 8:
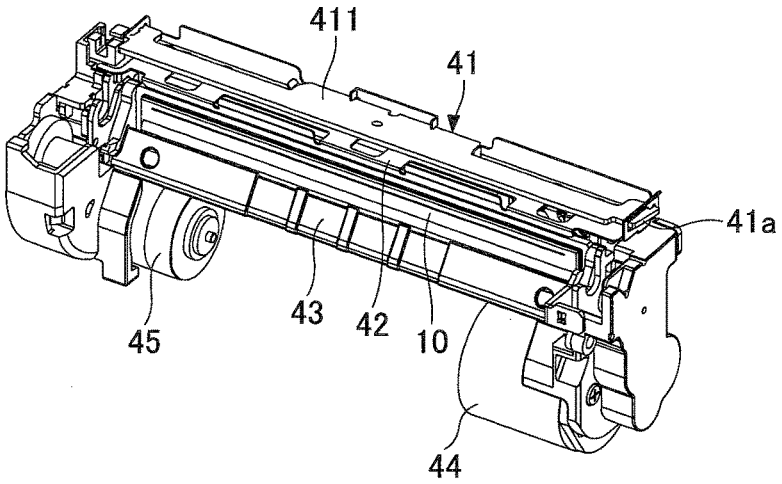
FIG. 8 is a diagram illustrating part of the printer according to the embodiment where a fixed blade is provided.
Figure 9:
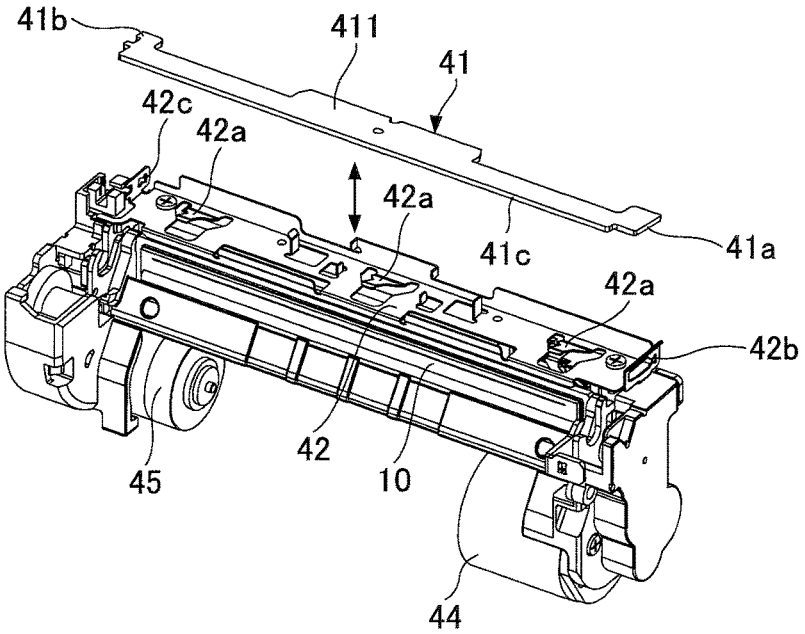
FIG. 9 is a diagram illustrating the part of the printer according to the embodiment where the fixed blade is provided.

Referring to FIG. 3, a rack 32*b* for moving the movable blade 31 is provided near each lengthwise end of the movable blade slider 32 on its first surface 321. The racks 32*b* are connected to pinions (not illustrated in the drawings) connected through gears to a below-described movable blade motor 45 (FIGS. 8 and 9). As a result, the pinions are caused to rotate by the rotation of the movable blade motor 45, and the rotations of the pinions are transmitted to the racks 32*b*, so that it is possible to move the movable blade slider 32. Thus, by moving the movable blade slider 32, it is possible to move the movable blade 31. The movable blade 31 and the movable blade slider 32 are provided on top of the movable blade frame 33, and the housing 34 is provided so as to cover the movable blade 31 and the movable blade slider 32. The housing 34 is formed of a material such as metal.

Furthermore, the platen roller 20 is rotatably attached to the movable blade frame 33. As described above, the platen roller 20 and the movable blade unit are attached to the lid 60 of the printer.

Figure 4:
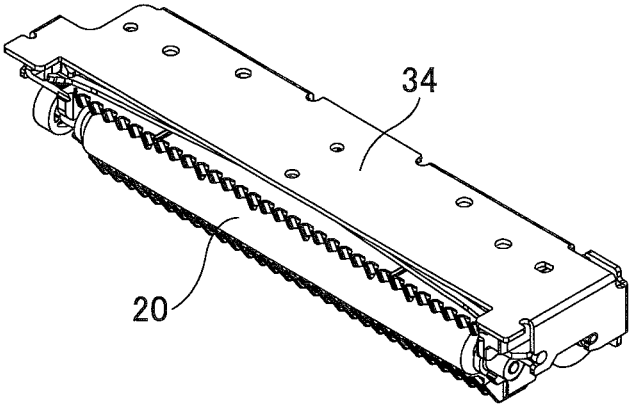
FIG. 4 is a perspective view of the movable blade unit of the printer according to the embodiment, where a platen roller is provided in the movable blade unit.
Figure 5A:
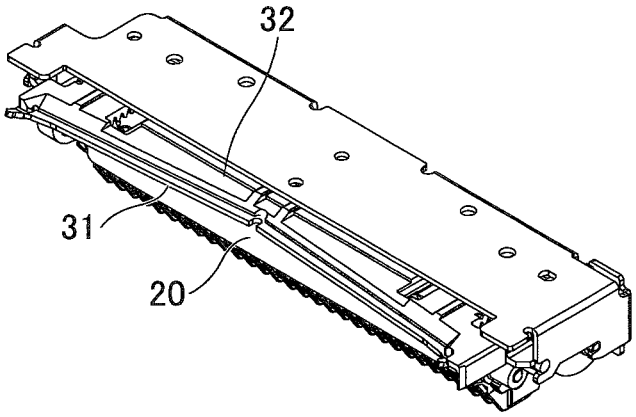
FIGS. 5A and 5B are perspective views of the movable blade unit of the printer according to the embodiment, where the platen roller is provided in the movable blade unit.
Figure 5B:
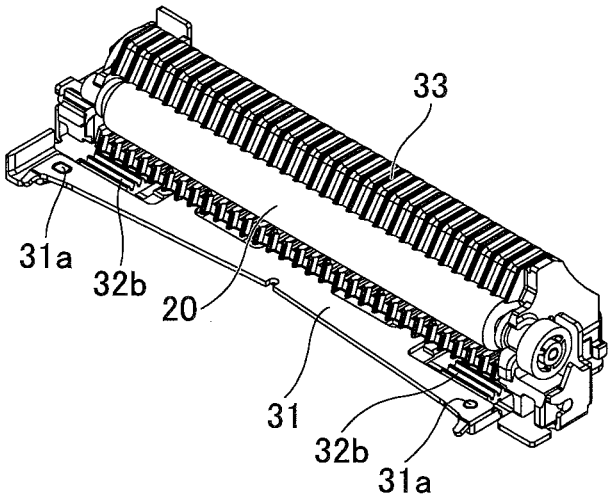
Figure 6A:
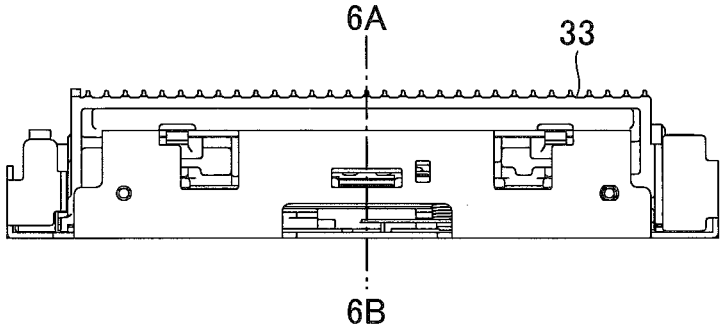
FIGS. 6A and 6B are structural diagrams of the movable blade unit of the printer according to the embodiment, where the platen roller is provided in the movable blade unit.
Figure 6B:
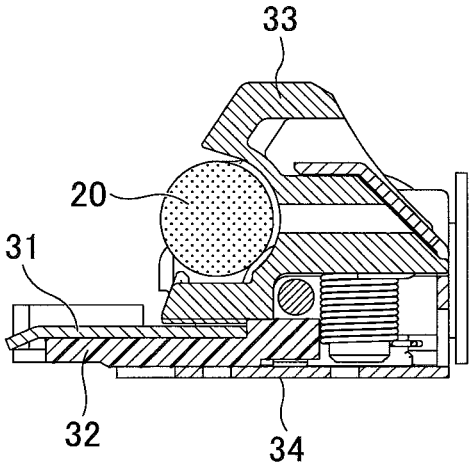

FIGS. 4, 5A, 5B, 6A and 6B illustrate an assembly of parts illustrated in the exploded view of FIG. 2. FIG. 4 is a top-side perspective view of the movable blade unit inside which the movable blade 31 is retracted. FIGS. 5A and 5B are a top-side perspective view and a bottom-side perspective view, respectively, of the movable blade unit from which the movable blade 31 is projecting. FIG. 6A is a rear view of the movable blade unit. FIG. 6B is a cross-sectional view of the movable blade unit from which the movable blade 31 is projecting, taken along a plane including a dot-dash line 6A-6B in FIG. 6A.

Figure 7A:
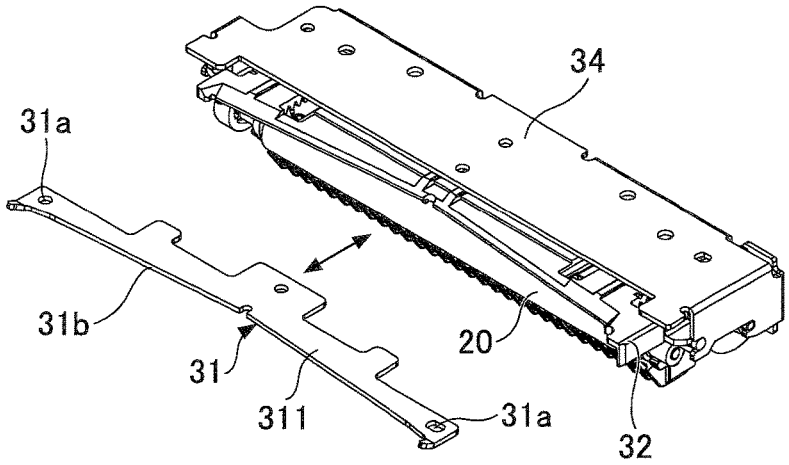
FIGS. 7A and 7B are diagrams illustrating the movable blade unit of the printer according to the embodiment, where a platen roller is provided in the movable blade unit.
Figure 7B:
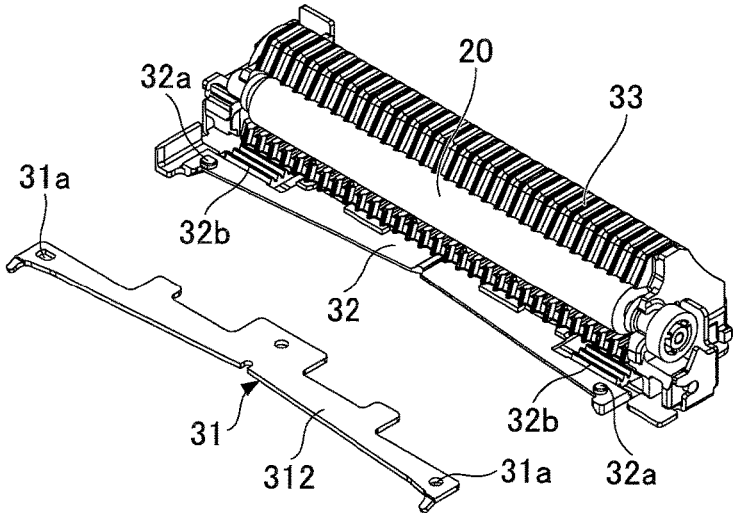

FIGS. 7A and 7B are a top-side perspective view and a bottom-side perspective view, respectively, of the movable blade unit from which the movable blade 31 is removed.

The movable blade 31 is provided with the projecting parts 32*a* on the movable blade slider 32 entering the corresponding openings 31*a* of the movable blade 31. Therefore, it is possible to easily remove the movable blade 31 from the movable blade unit by projecting the movable blade 31 from the movable blade unit when the lid 60 of the printer is open. Furthermore, it is possible to easily attach a replacement movable blade 31 to the movable blade slider 32.

With the lid 60 being closed, the movable blade 31 is pressed toward the movable blade slider 32 by the fixed blade spring 42 pressing the fixed blade 41 upward. Therefore, even when the movable blade 31 moves to project from the movable blade unit, the movable blade 31 is prevented from disengaging from the projecting parts 32*a* on the movable blade slider 32 at the openings 31*a*. That is, with the lid 60 being closed, the movable blade 31 is prevented from disengaging from the projecting parts 32*a* on the movable blade slider 32 at the openings 31*a* because a second surface 312 of the movable blade 31 opposite to its first surface 311 is in contact with and pressed by a first surface 411 (FIGS. 8 and 9) of the fixed blade 41. Accordingly, it is possible to cut the recording paper P with the movable blade 31 and the fixed blade 41 without disengagement of the movable blade 31 from the movable blade slider 32.

[Fixed Blade 41]

Next, the fixed blade 41 is described with reference to FIGS. 8 and 9. Projecting parts 41*a* and 41*b* are provided on both lengthwise ends of the fixed blade 41. The fixed blade 41 is provided on the fixed blade spring 42 so that a second surface (bottom surface in FIGS. 8 and 9) of the fixed blade 41 opposite to its first surface 411 faces toward the fixed blade spring 42. The fixed blade 41 is formed of a metal material or the like, and includes a blade edge 41*c* opposed to the movable blade 31. The fixed blade spring 42 is formed of a material such as metal and is provided with the springs 42*a* and openings 42*b* and 42*c*. With the fixed blade 41 being attached to the fixed blade spring 42, the springs 42*a* press the second surface of the fixed blade 41, and the projecting parts 41*a* and 41*b* on the fixed blade 41 are inserted in the openings 42*b* and 42*c*, respectively. The springs 42*a* are provided at three points on the fixed blade spring 42, and exert resilience in a direction to raise the fixed blade 41, that is, a direction to press the second surface of the fixed blade 41.

That is, the fixed blade 41 is provided with the projecting parts 41*a* and 41*b* on the fixed blade 41 entering the openings 42*b* and 42*c* in the fixed blade spring 42, respectively, and is raised (urged upward) by the springs 42*a*. Therefore, it is possible to remove the movable blade 41 from the fixed blade spring 42 by disengaging the projecting parts 41*a* and 41*b* on the fixed blade 41 from the openings 42*b* and 42*c* in the fixed blade spring 42, respectively.

The printer body 50 includes a conveyance motor 44 for conveying the recording paper P by rotating the platen roller 20 and the movable blade motor 45 for driving the movable blade 31.

By closing the lid 60, the conveyance motor 44 is connected to the platen roller 20 through gears (not illustrated), so that it is possible to cause the platen roller 20 to rotate when the conveyance motor 44 rotates. Furthermore, the pinions (not illustrated) connected to the movable blade motor 45 through gears (not illustrated) are connected to the racks 32*b* on the movable blade slider 32, so that it is possible to cause the movable blade 31 to move with the sliding of the movable blade slider 32 when the movable blade motor 45 rotates to slide the movable blade slider 32.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A printer, comprising:

a fixed blade and a movable blade that cut recording paper subjected to printing by a print head;

a movable blade slider formed of resin and including a plurality of projecting parts provided on a surface of the movable blade slider that faces a first surface of the movable blade opposite to a second surface thereof that comes into contact with the fixed blade;

a movable blade frame on which the movable blade slider is provided; and a plurality of racks configured to cause the movable blade slider to slide, wherein the racks are provided on the same surface of the movable blade slider as the projecting parts, and an entirety of each of the racks is at an intermediate position between lengthwise ends of the movable blade when viewed in a direction in which the movable blade slider slides, wherein the movable blade is provided on the movable blade slider with the projecting parts of the movable blade slider entering a plurality of openings provided in the movable blade, and the movable blade is held between the movable blade slider and the movable blade frame.

2. The printer as claimed in claim 1, further comprising:

a printer body; and a lid connected to the printer body so as to be opened and closed relative to the printer body, wherein the fixed blade is provided in the printer body, and wherein the movable blade is provided in the lid.

3. The printer as claimed in claim 1, further comprising:

a housing that covers the movable blade frame, wherein the movable blade and the movable blade slider are provided between the movable blade frame and the housing, wherein the movable blade, the movable blade slider, the movable blade frame, and the housing form a movable blade unit, and wherein the movable blade is configured to project from the movable blade unit.

4. The printer as claimed in claim 3, further comprising:

a platen roller, wherein the movable blade unit and the platen roller are provided in the lid, and wherein the print head is provided in the printer body.

5. The printer as claimed in claim 4, further comprising:

a conveyance motor for rotating the platen roller; and a movable blade motor for sliding the movable blade slider, wherein the conveyance motor and the movable blade motor are provided in the printer body.

6. The printer as claimed in claim 1, wherein the movable blade is provided on the movable blade slider with the projecting parts of the movable blade slider entering the openings provided in the movable blade with the first surface of the movable blade facing toward the surface of the movable blade slider.

7. The printer as claimed in claim 6, further comprising:

a spring, wherein the second surface of the movable blade comes into contact with a first surface of the fixed blade in cutting the recording paper, wherein a second surface of the fixed blade opposite to the first surface thereof is positioned on the spring, and wherein the spring exerts resilience in a direction to press the second surface of the fixed blade.

8. The printer as claimed in claim 1, wherein the fixed blade includes a projection provided at a lengthwise end thereof, and the fixed blade is attached to a fixed blade spring unit with the projection being inserted in an opening provided in the fixed blade spring unit, the fixed blade spring unit accommodating a spring that exerts resilience in a direction to press the fixed blade.

9. The printer as claimed in claim 1, further comprising:

a platen roller attached to the movable blade frame, wherein the movable blade slider is provided on an exterior of the movable blade frame to be across the movable blade frame from the platen roller.

10. A printer, comprising:

a fixed blade;

a movable blade;

a movable blade slider to which the movable blade is attached, the movable blade slider being configured to slide so that the movable blade moves on the fixed blade to cut recording paper subjected to printing by a print head;

a plurality of racks configured to cause the movable blade slider to slide;

a frame on which the movable blade slider is provided; and a platen roller attached to the frame, wherein the movable blade is held between the movable blade slider and the frame with a first surface of the movable blade being in contact with the movable blade slider and a second surface of the movable blade opposite to the first surface facing the frame, the movable blade slider includes a plurality of projecting parts provided on a surface of the movable blade slider that faces the first surface of the movable blade, and the movable blade is attached to the movable blade slider with the projecting parts entering a plurality of openings provided in the movable blade, and the racks are provided on the same surface of the movable blade slider as the projecting parts, and an entirety of each of the racks is at an intermediate position between lengthwise ends of the movable blade when viewed in a direction in which the movable blade slider slides.

11. The printer as claimed in claim 10, wherein the movable blade slider is formed of resin.

12. The printer as claimed in claim 10, wherein the movable blade slider is provided on an exterior of the frame to be across the frame from the platen roller.

* * * * *